United States Patent [19]

Benjamin

[11] 4,310,936

[45] Jan. 19, 1982

[54] WATER MATTRESS WITH INTERNAL DAMPING MEANS

[75] Inventor: Gary L. Benjamin, Mount Blanchard, Ohio

[73] Assignee: Kuss Corporation, Findlay, Ohio

[21] Appl. No.: 61,752

[22] Filed: Jul. 30, 1979

Related U.S. Application Data

[63] Continuation-in-part of Ser. No. 894,105, Apr. 6, 1978, Pat. No. 4,168,555.

[51] Int. Cl.[3] ..... A47C 27/08

[52] U.S. Cl. ..... 5/450; 5/451; 5/455

[58] Field of Search ..... 5/451, 452, 455, 449, 5/450, 422

[56] References Cited

U.S. PATENT DOCUMENTS

| | | | |
|---|---|---|---|
| 3,746,835 | 7/1973 | Yu et al. | 5/422 |
| 4,073,021 | 2/1978 | Carlisle | 5/450 |
| 4,168,555 | 9/1979 | Benjamin | 5/452 |
| 4,192,031 | 3/1980 | Fogel | 5/451 |

*Primary Examiner*—Roy D. Frazier

*Assistant Examiner*—Alexander Grosz

*Attorney, Agent, or Firm*—Wilson, Fraser, Barker & Clemens

[57] ABSTRACT

A water mattress has a portion of its volume occupied by air or gas filled bodies which lower the total mattress weight and inhibit the under damped natural harmonic motion typical of conventional water mattresses. A method of fabricating the water mattress of the instant invention is also disclosed. The gas filled bodies comprise independent, elongate, parallel chambers having sidewalls which are secured to the bottom panel of the mattress. The chambers are positioned to float between the horizontal midplane of the mattress and its upper surface such that it exhibits the uniform force per area weight distribution characteristic found desirable in such devices. Air is supplied to the chambers through generally aligned access fittings on the chambers and water mattress. The chambers are fabricated of a plurality of staggered, overlapped rectangles of plastic, each having a length substantially equal to the length of the mattress and a width approximately equal to twice the chamber to chamber distance measured along the surface of the chamber structure.

8 Claims, 5 Drawing Figures

FIG. 3
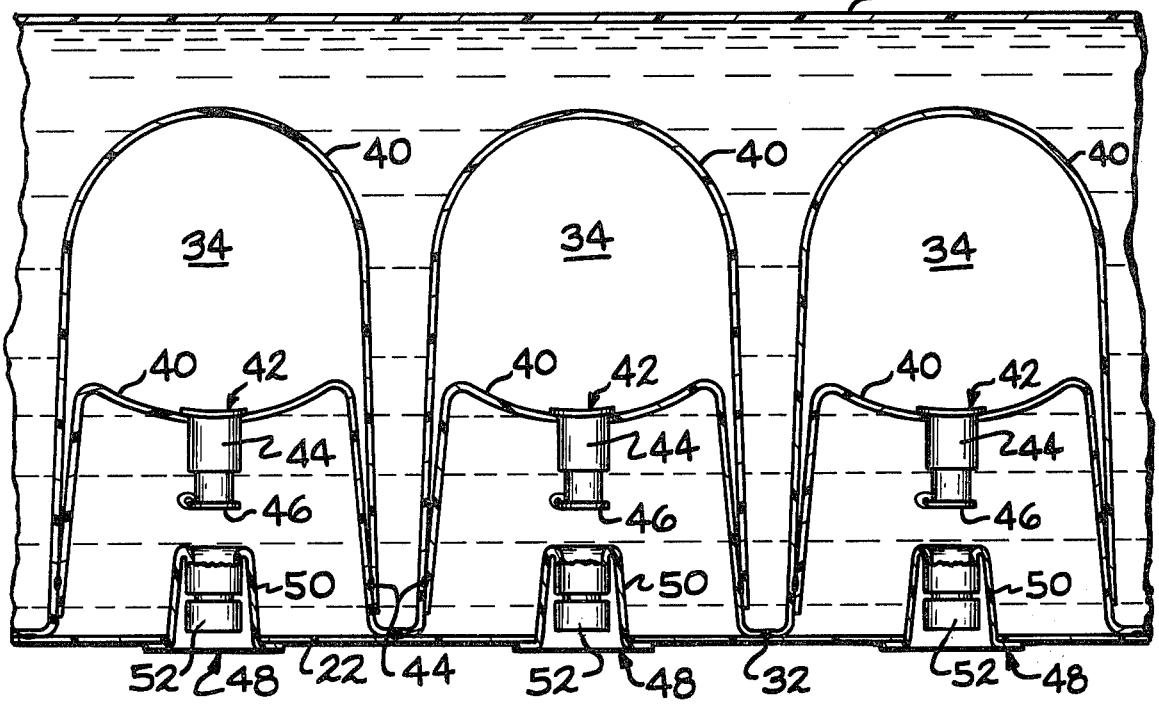
FIG. 4
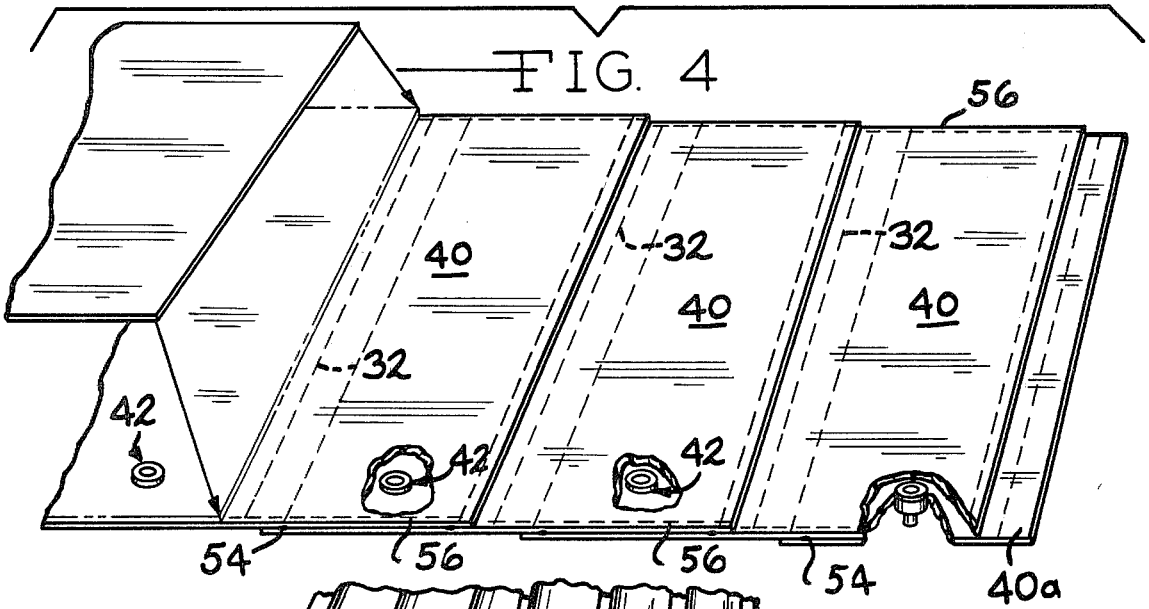
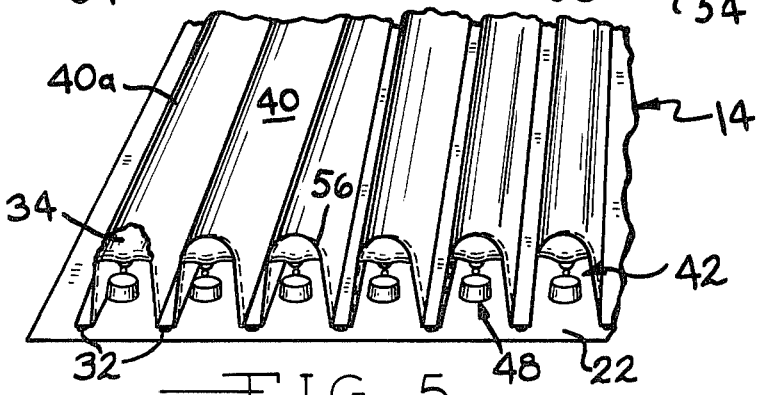
FIG. 5

WATER MATTRESS WITH INTERNAL DAMPING MEANS

This is a continuation-in-part of application Ser. No. 894,105, filed on Apr. 6, 1978, now U.S. Pat. No. 4,168,555 granted Sept. 25, 1979.

BACKGROUND OF THE INVENTION

The instant invention relates generally to water mattresses and more specifically to water mattresses having gas filled chambers secured within the water mattress.

Within the last decade, water mattresses have progressed from a diversion to a desirable alternative to a conventional inner spring or foam mattress. Whereas early designs were prone to premature and catastrophic failure caused by rupture of the plastic mattress wall and loss of the water contained therein, improved materials, sophisticated designs and better manufacturing techniques have increased the service life of such mattresses to the point where failure of the plastic mattress wall is uncommon indeed.

Certain characteristics of water mattresses have, however, inhibited even wider acceptance. The foremost problem is weight. A 72 inch by 84 inch by 9 inch king size mattress contains in excess of 31 cubic feet of water which weighs nearly 2,000 pounds. It is apparent why cautious home owners have been discouraged from purchasing such mattresses. It is equally apparent why landlords have prohibited the use of such mattresses in their leaseholds. Attempts to minimize the weight of water mattresses have met with little success. Clearly, the area of a given mattress is a constraint and thus only the thickness can be diminished. However, it has been determined that a mattress thickness of less than approximately 9 inches may render it uncomfortable under certain circumstances.

Other undesirable and related characteristics of water mattresses are the natural harmonic or wave motion and the response to impulse excitation they exhibit. Subjected to a wave generating movement, a water mattress will exhibit decaying simple harmonic wave motion which many users find objectionable. Since water is incompressible, a single pressure-producing impulse will be transmitted undiminished away from the point of application, be reflected off the boundaries of the mattress and also slowly decay. Various approaches have been used to damp the wave motion but they have been relatively unsuccessful. Internal baffles have been placed within a mattress but they frequently generate sloshing noises. Furthermore, since they merely transmit an impulse from one face to the other, they have no absorbing or decaying effect on such a disturbance. The cost of manufacturing an internally baffled mattress also militates against such a design. The use of viscous fluids such as gelatins or mud has also been suggested but their use substantially negatives the generally simple drainage procedure and portability benefits associated with such mattresses.

SUMMARY OF THE INVENTION

The instant invention comprises a water mattress having a plurality of longitudinally extending gas filled chambers and a method for making same. The external shape of the mattress is conventional. Internally, however, the gas chambers occupy a substantial portion of the volume occupied by water in a conventional water mattress. The total, filled weight of a water mattress according to the instant invention may be as little as one half the weight of a conventional mattress although of the same external dimensions. The gas chambers which are formed from a plurality of overlapped plastic panels float within the filled water mattress between the horizontal midplane and the upper surface thereof. They absorb impulse and harmonic wave energy induced into the water by external excitation and damp what would otherwise by the slowly decaying simple harmonic motion of the water contained within the water mattress.

The gas chambers are formed from a plurality of plastic panels having length substantially equal to the length of the chambers and width approximately equal to twice the chamber to chamber distance measured along the surface of the chamber structure. The panels are aligned with their length aspects parallel and in half-overlapped, shingle-like arrangement, and sealed by the application of radio frequency energy along their lengths and across their ends to form gas chambers. The resulting structure is then pleated lengthwise and secured to the bottom panel of the water mattress. Each of the gas chambers may be individually filled to a desired independent low pressure to provide variable characteristics of motion damping and softness to the filled water mattress.

Thus it is an object of this invention to provide a water mattress having external dimensions equivalent to standard water mattress but which weighs substantially less than such mattresses.

It is a further object of the instant invention to provide a water mattress including means which damp the impulse and harmonic wave motion characteristic of such water mattress.

It is a further object of the instant invention to provide a water mattress having internal air chambers which are independently inflatable and collapsible to adjust the overall resiliency and damping characteristics of the water mattress.

It is a still further object of the instant invention to provide a method of fabricating such water mattress and damping means.

Other objects and advantages of the invention will become apparent from the following detailed description, with reference being made to the accompanying drawings.

BRIEF DESCRIPTION OF THE DRAWINGS

FIG. 3 is an enlarged, fragmentary, full sectional end view of a water mattress according to the instant invention;

FIG. 4 is an enlarged, fragmentary, perspective view of the gas chamber assembly during construction; and FIG. 5 is a perspective view of the gas chamber assembly in place on the mattress bottom panel.

DESCRIPTION OF THE PREFERRED EMBODIMENT

Figure 1:
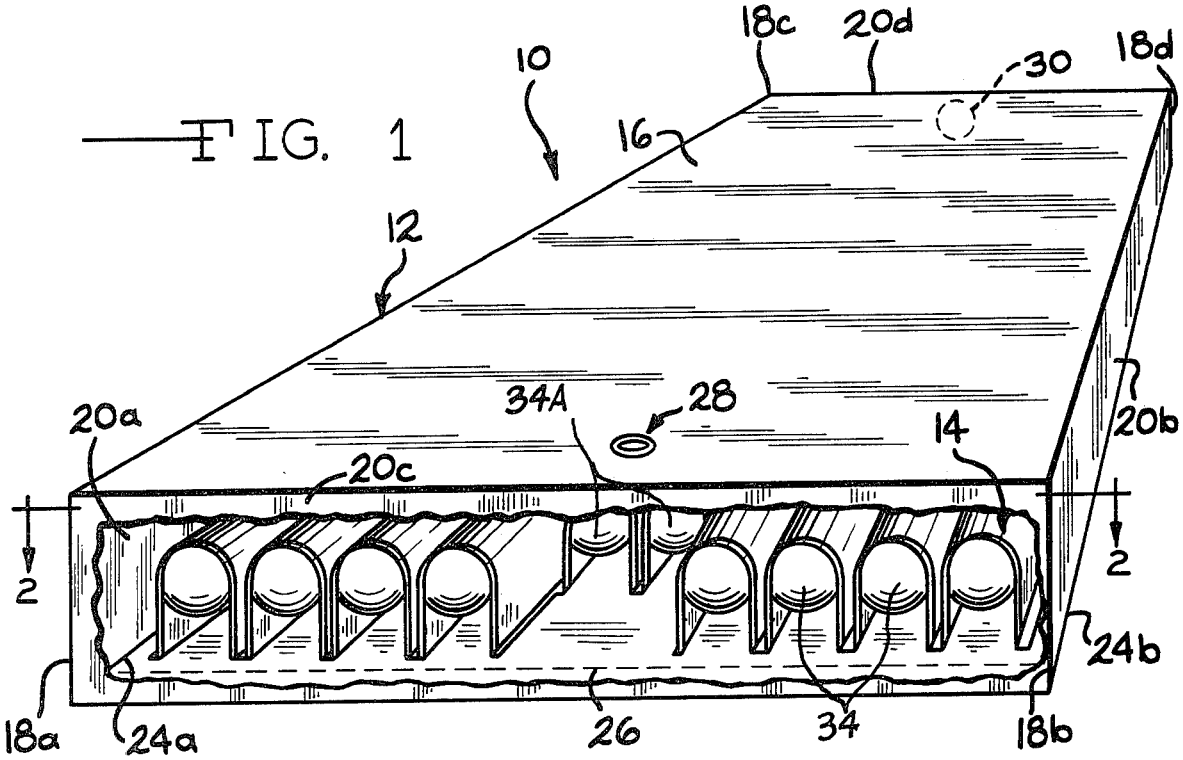
FIG. 1 is a perspective view of a water mattress according to the instant invention with an end panel broken away.

In FIG. 1, a water mattress of the preferred embodiment is generally designated by the reference numeral 10. The water mattress 10 generally comprises two flexible, preferably plastic assemblies, a mattress panel assembly 12 and a gas chamber assembly 14.

The mattress assembly 12 includes a unitary panel 16 which forms the outer surface of the water mattress 10 and is assembled according to the teachings of my issued U.S. Pat. No. 4,100,634. Preferably, the width of the panel 16 is the width of the water mattress 10 plus two times its height. The length of the panel 16 is two times the length of the water mattress 10 plus two times its height. At each vertical corner 18A, 18B, 18C and 18D, side panels 20A and 20B are overlapped and sealed to adjacent end panels 20C and 20D by the application of radio frequency energy. The remaining seams of the mattress panel assembly 12 form a generally "H" shaped pattern in its bottom plane. That is, the intersecting vertical side panels 20A and 20B and a horizontal bottom panel 22 are sealed along two longitudinal seams 24A and 24B. The bottom panel 22 is also formed from portions of the panel 16 and is sealed by a transverse seam 26 extending between the longitudinal seams 24A and 24B. In the instant invention, the seam 26 is adjacent one end of the mattress assembly 12. (This is in distinction to the seam placement in my referenced patent in which the seam is placed at approximately the midline of the bottom panel.) This location of the seam 26 is preferred in order to avoid multiple (i.e., four) layer seams resulting from the attachment of the gas chamber assembly 14, which will be described subsequently.

The top portion of the water mattress assembly 12 also includes a fill assembly 28. The fill assembly 28 may consist of a cappable or threaded fitting and appropriate seal means through which water may be added or removed from the water mattress 10 in a conventional fashion. Finally, the water mattress assembly 12 includes a small patch 30 which covers and seals an access opening in the water mattress 10 which facilitates fabrication and sealing of the various seams during manufacture of the mattress 10.

Figure 2:
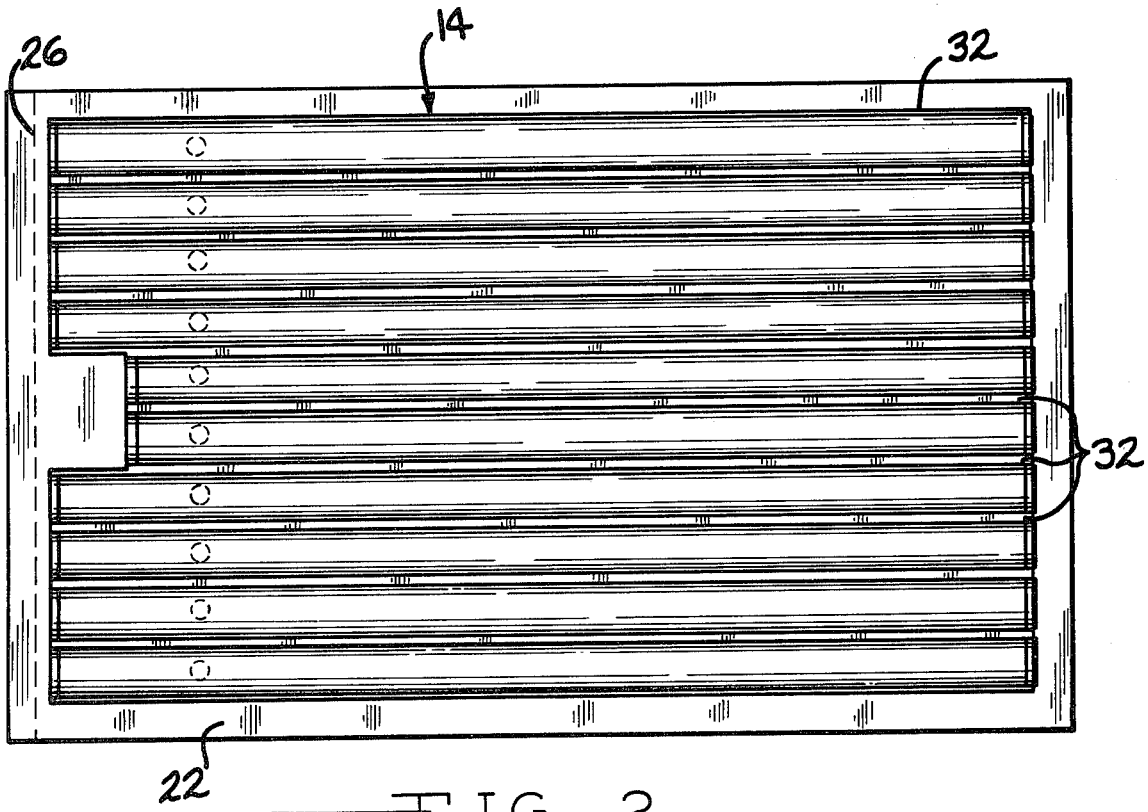
FIG. 2 is a plan view of a water mattress according to the instant invention taken along line 2—2 of FIG. 1.

Referring now to FIGS. 1 and 2, the bottom panel 22, gas chamber assembly 14 and the transverse seam 26 are illustrated. The gas chamber assembly 14 is sealed to the bottom panel 22 along longitudinal seams 32 which extend substantially its full length. The gas chamber assembly 14 illustrated in FIG. 2 defines ten independent chambers 34 separated by the longitudinal seams 32. Ten chambers have been found preferable for incorporation into a queen size (60 inches by 80 inches) water mattress whereas twelve of the chambers 34 have been found preferable in a king size (72 inches by 84 inches) water mattress. The number of chambers 34 utilized in a given size mattress just recited, while preferred, should not be construed to limit the scope of the instant invention. Rather, it should be appreciated that more or fewer chambers 34 may be incorporated in the water mattress 10 according to such parameters as expense, volume of the mattress desired to be occupied by the chambers, the inflated diameter of the chambers and the desired degree of damping. The centrally disposed chambers 34A may be truncated in the region proximate the filler assembly 28 to facilitate supply and withdrawal of water from the water mattress 10.

Referring now to FIGS. 3 and 4, the gas chamber assembly 14 is illustrated. The gas chamber assembly 14 is comprised of a plurality of overlapping panels 40. The panels 40 are somewhat shorter than the overall length of the water mattress 10. The width of the panels 40 is approximately twice the chamber to chamber distance measured along the outer periphery of the chambers 34. The width of the overlap of one panel 40 to an adjacent panel 40 is slightly less than one-half its width. Each of the panels 40 includes an air fill assembly 42. The air fill assemblies 42 each consists of a support and mounting structure 44 whch is sealed to the panel 40 and a selectively removable cap means 46 which provides access to or seals off each of the chambers 34. Aligned with each of the air fill assemblies 42 is an access assembly 48. The access assemblies 48 each include a mounting and support means 50 generally similar to the mounting and support means 44 of the air fill assemblies 42 which is sealed to the bottom panel 22 of the water mattress assembly 12. The access assemblies 48 also each include a selectively removable cap means 52 which provides access to or seals off the interior of the water mattress 10 and specifically the air fill assemblies 42.

Fabrication of the gas chamber assembly 14 is straightforward and is specifically illustrated in FIG. 4. First of all, an opening (not illustrated) is provided in each of the panels 40 and the air fill assembly 42 is sealed therein by conventional means. The number of panels 40 utilized to produce a given gas chamber assembly 14 will vary in accordance with two considerations. First of all, in this overlapped arrangement, a given one of the panels 40 forms a portion of two adjacent chambers 34. Specifically, a panel 40 forms the lower panel of one of the chambers 34 while forming the upper or peripheral portion of the adjacent chamber 34. Secondly, each gas chamber assembly 14 will include a foreshortened terminal panel 40A on each edge. The terminal panels 40A will always be adjacent the edges of the gas chamber assembly 14 where the other panel of the edge gas chamber 34 is formed by a full panel 40. Thus, in a queen size mattress according to the preferred embodiment which incorporates ten gas chambers 34, nine of the full panels 40 and two of the foreshortened, terminal panels 40A will be utilized.

The panels 40 and terminal panels 40A are overlapped as is illustrated in FIG. 4 with adjacent edges of alternate panels 40 laterally spaced apart from one another such that a maximum thickness of two panels exists and are sealed along edge and longitudinal seams 54. Next, the ends of the gas chamber assembly 14 are sealed along end seams 56 which extend the full width of the gas chamber assembly 14. For reference purposes only, the location of longitudinal seams 32 along which the gas chamber assembly 14 is secured to the bottom panel 22 are illustrated in phantom lines. It should be noted that the longitudinal seams 32 are located substantially midway between the panel to panel longitudinal seams 54 which form the chambers 34, in the region of the assembly 14 having a single thickness.

Referring now to FIG. 5, the positioning and securement of the gas chamber assembly 14 to the bottom panel 22 of the water mattress assembly 12 is illustrated. The completed gas chamber assembly 14 is disposed generally parallel to an edge of the bottom panel 22 as illustrated in FIG. 2. The gas chamber assembly 14 is then sealed to the bottom panel 22 along a first seam 32. The first chamber 34 and its associated panels 40 and 40A are folded or pleated into a generally U-shaped configuration as is illustrated in FIG. 5, with the fill assembly 42 and the access assembly 48 in substantial alignment. Then, a second attachment seal along the seam 32 is effected. The folding and sealing operation is repeated until all of the panels 40 of the gas chamber assembly 14 are secured in a like manner to the bottom panel 22 of the water mattress assembly 12. Subsequent to the completion of this operation, the water mattress assembly 12 may be appropriately sealed along the bottom panel transverse seam 26, the longitudinal seams 24A and 24B and and seams in the corners 18A, 18B, 18C and 18D in the manner described in my previously issued U.S. patent.

With reference to FIG. 3, one novel feature of the instant invention should be particularly noted. It has now been found beneficial to position the centers of the air chambers 34 between the horizontal midplane of the mattress 10 and the upper panel 16 of the mattress 10. However, it has been determined that over the life of a water mattress the plastic panels which constitute the gas chamber assembly 14 tend to deform and stretch due to the constant upward tension exerted thereon by the gas within the chambers 34. In order to extend the service life of the water mattress 10, it has been found desirable to compensate for this deformation and slow upward movement of the center of the gas chambers 34 by initially sizing the plastic panels 40 such that the center of the gas chambers 34 is somewhat below that desired. The stretching of the plastic panels 40 which occurs rapidly at first and more slowly later thus results in an optimally positioned chamber 34. For example, in a water mattress having a thickness of approximately 9 inches, the width of each of the plastic panels 40 initially is preferably approximately 26 inches and the distance between the parallel seams 32 is approximately 5½ inches. With the chambers 34 filled to between 80% and 90%, the upper surfaces of the gas chamber assembly 14 will be approximately 1½ inches to 2 inches below the top panel 16 of the water mattress assembly 12. As the vertical portions of the panels 40 stretch, the upper surfaces of the gas chamber assembly 14 will move closer to the top panel 16. Ultimately, the spacing may reduce to ¾ inch to 1¼ inches. Thus, proper spacing between the upper surfaces of the gas chamber assembly 14 and the top panel 16 and retention of the centers of the air chambers 34 generally between the horizontal midplane of the water mattress 10 and its upper panel 16 are maintained throughout the life of the water mattress 10.

The foregoing disclosure is the best mode devised by the inventor for practicing this invention. It is apparent, however, that devices and methods incorporating modifications and variations to the instant invention will be obvious to one skilled in the art of water mattresses. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What I claim is:

1. A water mattress comprising a pliable liquid impervious envelope having an upper and a lower panel, a plurality of chamber defining means disposed within said envelope for damping water motion, said chamber defining means including a plurality of chamber panels having two opposed, coextensive surfaces, a first portion of one of said surfaces of at least one of said panels defining an inner surface of one of said chambers and a second portion of said one of said surfaces defining an outer surface of an adjacent one of said chambers and means for filling said chambers with a gas.

2. The water mattress of claim 1, further including means for positioning said chambers in spaced apart relationship from said upper panel.

3. The water mattress of claim 1, further including at least one end panel having two opposed coextensive surfaces, one of said end panel surfaces defining an outer surface of one of said chambers and the other end panel surface defining an inner surface of said one of said chambers.

4. The water mattress of claim 3, wherein said chamber panels are substantially twice as wide as said end panel.

5. The water mattress of claim 1 wherein said chamber defining means is secured to said lower panel between each of said chambers.

6. A water mattress comprising in combination a flexible water impervious envelope having a top panel and a bottom panel vertically spaced from said top panel and a plurality of adjacent gas containing structures secured to said bottom panel of said mattress, each of said gas containing structures having an upper panel and a lower panel, at least one adjacent pair of gas containing structures having a shared unitary panel forming the upper panel of one of said adjacent pair of structures and the lower panel of the other of said pair of adjacent structures.

7. The water mattress of claim 6 further including independent means associated with each of said gas containing structures for filing said structures with a gas.

8. The water mattress of claim 7 wherein said independent filling means comprises access fittings disposed in substantial alignment on said lower panel of said gas containing structures and said bottom panel of said envelope.

* * * * *